US005731571A

United States Patent [19]

Park

[11] Patent Number: 5,731,571

[45] Date of Patent: Mar. 24, 1998

[54] MICROWAVE OVEN HAVING A SWITCH-ACTUATING DISPLAY PROTECTOR

[75] Inventor: Geun Yong Park, Suwon, Rep. of Korea

[73] Assignee: Samsung Electronics Co., Ltd., Suwon, Rep. of Korea

[21] Appl. No.: 741,362

[22] Filed: Oct. 30, 1996

[30] Foreign Application Priority Data

Dec. 19, 1995 [KR] Rep. of Korea ..... 95-52133

[51] Int. Cl.[6] ..... H05B 6/68

[52] U.S. Cl. ..... 219/720; 219/702; 219/506

[58] Field of Search ..... 219/720, 702, 219/719, 506; 340/815.55, 815.48, 815.83, 815.85

[56] References Cited

U.S. PATENT DOCUMENTS

| | | | |
|---|---|---|---|
| 4,431,893 | 2/1984 | Levie | 219/720 |
| 4,517,428 | 5/1985 | Matsushima | 219/720 |
| 5,183,984 | 2/1993 | Nakagawa | 219/720 |
| 5,272,300 | 12/1993 | Edamura | 219/720 |

FOREIGN PATENT DOCUMENTS

| | | | |
|---|---|---|---|
| 53-27142 | 3/1978 | Japan | 219/720 |
| 2-68880 | 3/1990 | Japan | 219/720 |

*Primary Examiner*—Philip H. Leung
*Attorney, Agent, or Firm*—Burns, Doane, Swecker & Mathis, L.L.P.

[57] ABSTRACT

A microwave oven includes a control panel having switches enabling a user to input cooking functions, and a display for displaying data representative of input functions. A transparent display protector overlies the display and is displaceable inwardly toward the display to actuate some of the switches, including an on-off switch. Sections of the protector are movable inwardly relative to one another to actuate respective switches. Springs yieldably bias the protector away from the display.

8 Claims, 5 Drawing Sheets

MICROWAVE OVEN HAVING A SWITCH-ACTUATING DISPLAY PROTECTOR

FIELD OF THE INVENTION

The present invention relates generally to a microwave oven. More particularly, it relates to a microwave oven which has switches employed for controlling the microwave oven, and a display unit used for displaying the information input by means of the switches.

BACKGROUND OF THE INVENTION

Attention is first invited to FIGS. 4 and 5, respectively, depicting a microwave oven with a control panel manufactured by a conventional technique.

As shown in FIGS. 4 and 5, the conventional microwave oven includes a main body 10. The main body 10 is divided into a cooking chamber (not illustrated) in which foodstuffs are cooked by microwave energy, and an electrical component compartment 30 which accommodates a plurality of electrical components. More specifically, the electrical component compartment 30 contains a magnetron 31 which serves as a high-frequency microwave generating unit and produces high-frequency microwaves to the interior of the cooking chamber (not illustrated), a high-voltage transformer 32 and a high-voltage capacitor 33 that supply the magnetron 31 with high voltages, respectively.

The main body 10 also includes a door 40 attached to the front of the main body 10 to open and close the opening to the cooking chamber, and a control panel 50 disposed on the front of the electrical component compartment 30 with a set of function buttons and switches.

The control panel 50 includes a keyboard 52 consisting of a set of function buttons by which a user can input various commands to start, stop, or control the microwave oven, an operating switch 53 used for actuating the microwave oven in response to the input command, and a button 58 installed under the operating switch 53, supported by an elastic member 57, and used for opening and closing the door 40.

The control panel 50 also has a circuit board 51 whose front contains a display 54 and a plurality of electrical components 56, and a display protecting member 55 which is installed on the front of the display unit 54 to allow the display unit 54 to clearly indicate the information relating to the operating state of the microwave oven. The above-described circuit board 51 is fixed to a panel 59 by the use of screws and the like.

After putting food in the cooking chamber of a conventional microwave oven having the above-described construction, the user inputs the information on the cooking time, a cooking method and the like into the microwave oven system according to the kind of a food to be cooked, its weight, and its bulk by means of the function buttons of the keyboard 52. After that, he checks to see whether or not the input information is correct by using the display unit 54, and then pushes the operating switch 53 to operate the microwave oven for cooking.

Since the microwave oven is equipped with a plurality of function buttons for making selections from a series of cooking menus on its restricted area, each function button has to be small in size, and the keyboard having a set of the function buttons takes up much space in the limited area of the control panel thereby causing the size of the operating switch to be made smaller. It is not easy for users to press such a small-sized operating switch with their hands, particularly with a hand smeared with oil during cooking.

Moreover, the display unit and the keyboard are designed to be spaced from one another on the respective upper and lower sections of the control panel of the conventional microwave oven. Thus, after a user sees if the information on the cooking time or the selection of a cooking menu is correctly input to the microwave oven system through the display unit, he stops to confirm the position of the operating switch and then depresses it to start the microwave oven.

Such an arrangement in which the display unit and the keyboard are disposed on respective upper and lower sections of the control panel inconveniences users, and it is more difficult to operate.

SUMMARY OF THE INVENTION

Accordingly, the present invention is directed to a microwave oven of improved structure which can substantially eliminate the limitations and disadvantages of the conventional art.

It is an objective of the present invention to provide a microwave oven in which the display unit for presenting the data on the operation and a starting switch for activating the microwave oven are formed at the same location of the control panel, and the size of function buttons are increased in size than those of the conventional ones in a limited area of the control panel for the purpose of offering greater convenience to the users.

The objectives and other advantages of the present invention will be realized and attained by the structure particularly pointed out in the written description and appended drawings.

To accomplish these and other advantages, the present invention involves a microwave oven including a main body that has a cooking chamber; a high-frequency microwave generating unit which is installed in the main body and produces high-frequency microwaves to the cooking chamber's interior; and a control panel that is disposed at the front of the main body.

The inventive microwave oven also includes a display unit which is used to present the data on the cooking time and a cooking menu input by a user to the microwave oven system; a display protecting member that is disposed on the front of the main body to be elastically movable; and a plurality of switches actuated by being contracted with corresponding portions of the display protecting member.

The display protecting member is designed to move forward and backward with respect to the display unit. Surfaces of the display protecting member that are facing the display unit may come into contact with their corresponding switches. In addition, a plurality of elastic members are interposed between the display protecting member and the switches.

In order to actuate one of the predetermined switches, a user depresses a portion of the display protecting member which corresponds to the switch.

BRIEF DESCRIPTION OF THE ATTACHED DRAWINGS

DETAILED DESCRIPTION OF THE PREFERRED EMBODIMENT

The preferred embodiment of the present invention will now be described in detail with reference to the accompanying drawings.

Figure 1:
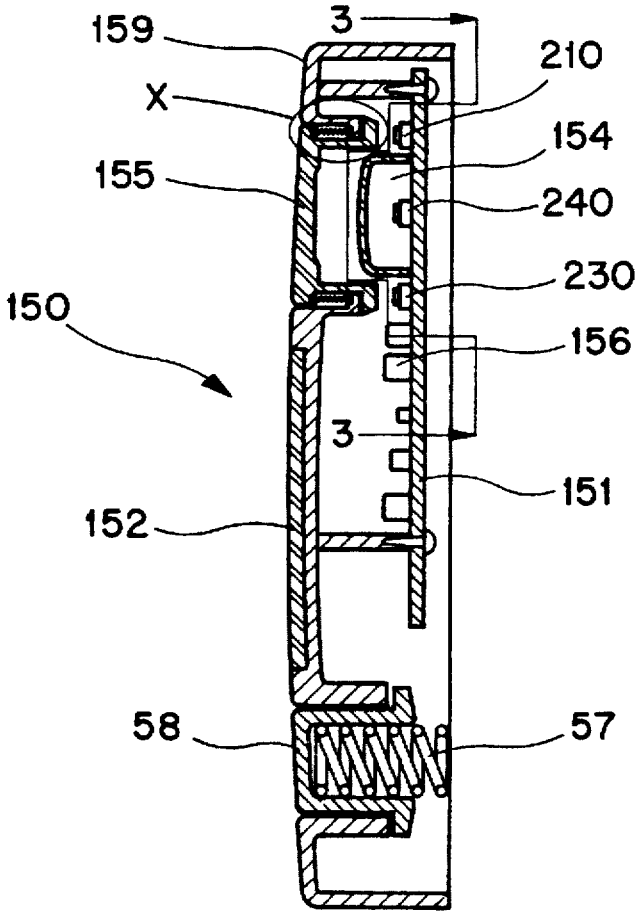
FIG. 1 is a side-sectional view of a control panel in accordance with the present invention.
Figure 2:
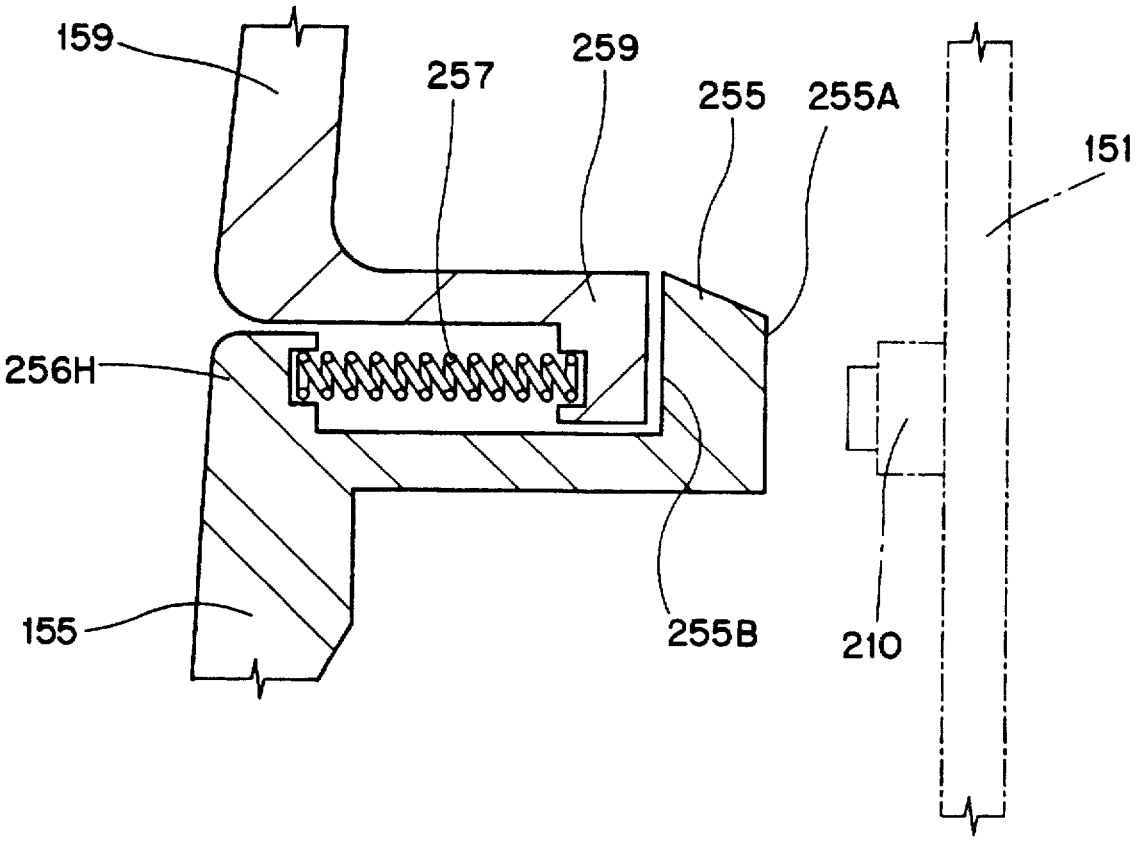
FIG. 2 is an enlarged-sectional view of a part indicated by X in FIG. 1.
Figure 3:
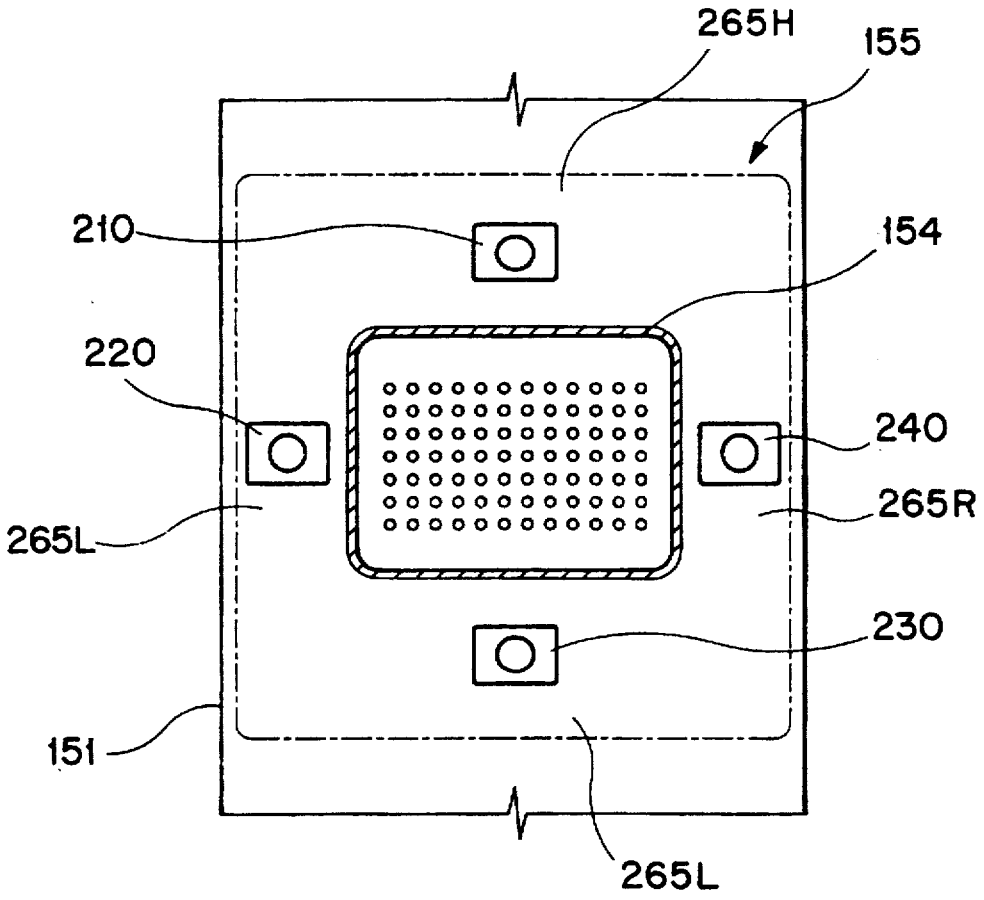
FIG. 3 depicts a sectional view as taken along line 3—3 of FIG. 1.
Figure 4:
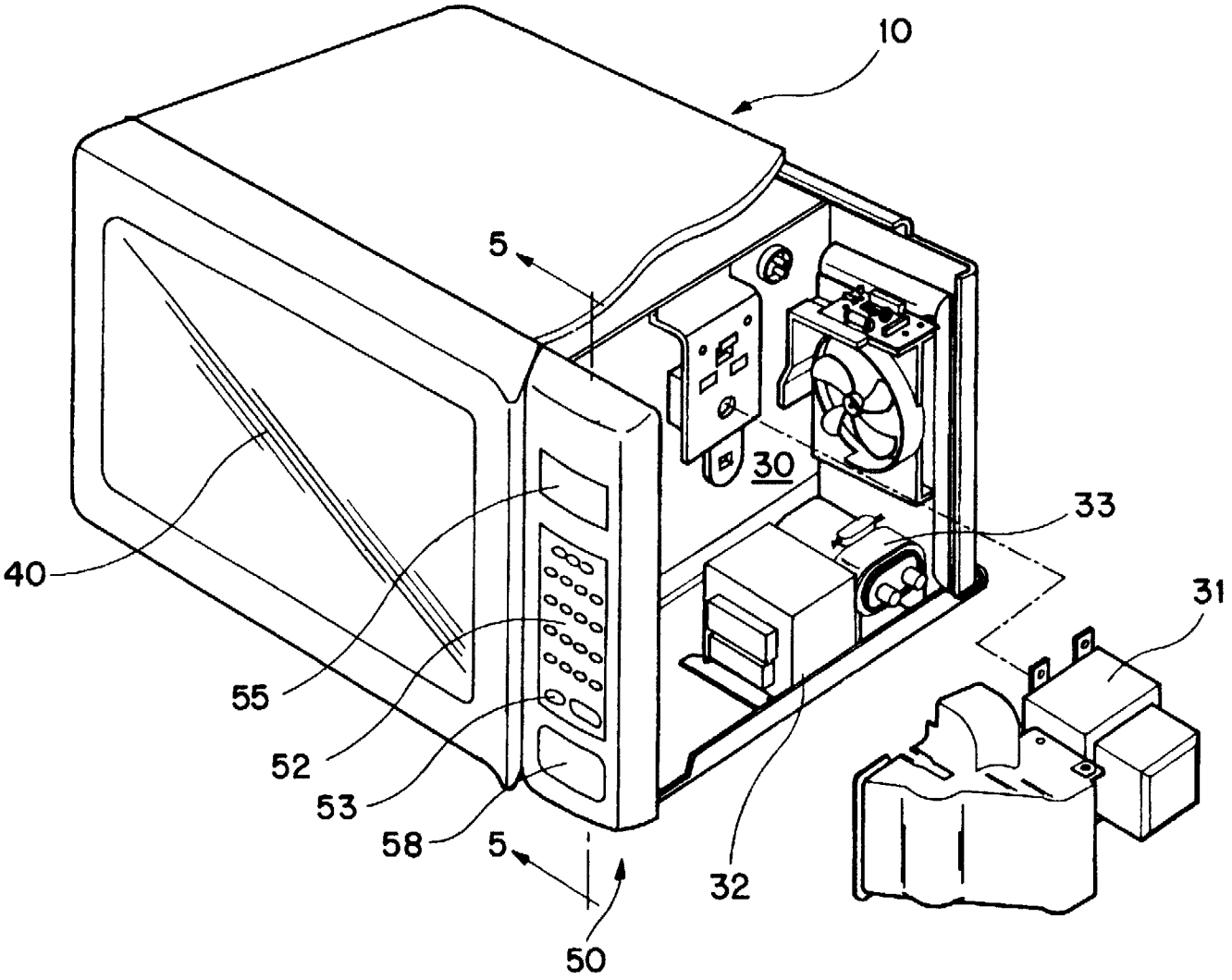
FIG. 4 (PRIOR ART)
FIG. 4 shows a cutaway-perspective view of a conventional microwave oven.
Figure 5:
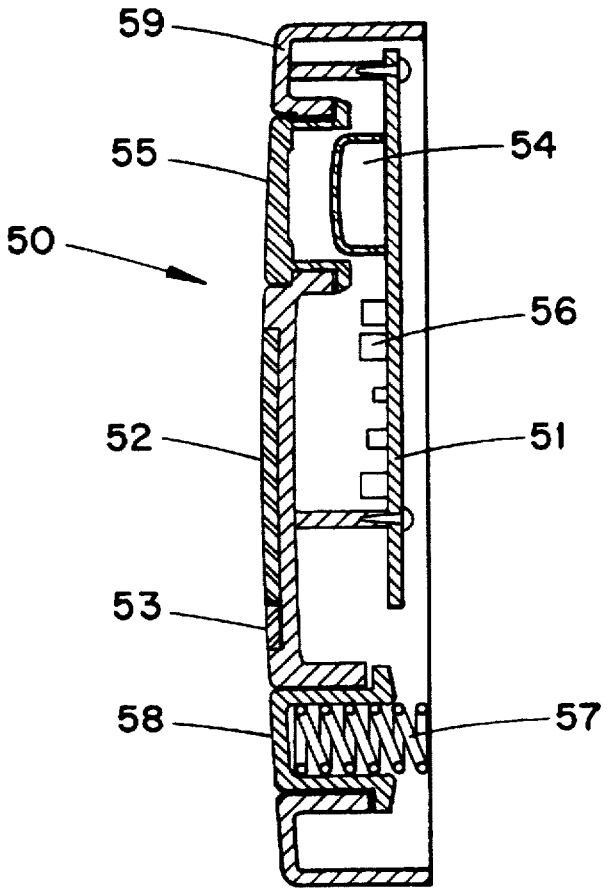
FIG. 5 (PRIOR ART)
FIG. 5 shows a sectional view as taken along line 5—5 of FIG. 4.

FIGS. 1, 2 and 3, respectively, depict a microwave oven in accordance with the present invention.

As shown in FIG. 1, a control panel 150 of the present invention includes a keyboard 152 in which a set of function button switches are formed to be used for feeding various commands to control the operation of the microwave oven, and a display protecting member 155 actuates an operating switch 210 used for operating the microwave oven to carry out the input command.

The control panel 150 also includes a circuit board 151 whose front contains a display unit 154 for presenting the information input by the function button switches and electrical components 156, and this circuit board 151 is fixed to a panel 159 by the use of screws and the like. On the front of the panel 159 are a plurality of tack switches 210, 220, 230 and 240 mounted around the display unit 154.

A compression spring 257 is interposed between the panel 159 and the display protecting member 155 so that the display protecting member 155 can be movable left and right (i.e., out and in) when viewed from FIG. 2. The compression spring 257 has one end supported by a blocking portion 259 of the panel 159, and the other end supported by a front section 256H of the display protecting member 155.

In the meantime, a lug 255 is formed to prevent the display protecting member 155 from springing out of the panel 159 by an elastic force produced by the compression spring 257. When the compression spring 257 is in an expanded condition, in other words, when the display protecting member 155 is not pressed yet, a stop 255B which is on the left side of the lug 255 is in continuous touch with the blocking portion 259 of the panel 159, and a contact portion 255A which is on the right side of the lug 255 is disposed opposite to the tack switch 210.

A plurality of the lugs 255 are disposed around the display protecting member 155, opposite respective tack switches 210, 220, 230 and 240. In this preferred embodiment of the present invention, there are four lugs 255, and four springs 257 which are each interposed between the panel 159 and the display protecting member 155.

The springs 257 are disposed between the panel 159 and the display protecting member 155 so that when a user presses the front portion 256H of the display protecting member 155 corresponding to the tack switch 210, the front portions 265L, 265R and 265L of the display protecting member 155 corresponding to the tack switches 220, 230 and 240, respectively, cannot compress their corresponding springs 257.

If, for example, the tack switch 210 is in charge of starting the cooking function, the tack switch 230 could effect a cancellation of the input command, and if the tack switch 220 were in charge of extending the cooking time that is preset by a user, the tack switch 240 could serve to reduce the preset cooking time.

The following description relates to the operation of the inventive microwave oven equipped with the above-described control panel.

If a user presses the button 58, door 40 of the microwave oven opens. After he puts food to be cooked in its cooking chamber, he closes the door 40 and inputs information relating to the cooking conditions as he desires to the microwave oven system by means of the button switches of the keyboard 152 whose contact surface is larger in size than those of conventional art.

Once the user presses the front portion 265H of the display protecting member 155, the contact portion 255A of the lug 255 depresses the tack switch 210 which is in charge of starting the cooking function to thereby initiate the operation of the microwave oven.

In case that the user tries to change the cooking conditions, he should press the lower front portion 265L of the display protecting member 155 because the command that is already input by him can be cancelled since the lower front portion 265L will depress the tack switch 230 which cancels the input command.

If the user wants to extend the current cooking time while the microwave oven is in operation, he should press the left-side front portion 265L of the display protecting member 155 corresponding to the tack switch 220 which is in charge of the extension of cooking time. As he presses the left-side front portion 265L, there occurs a change in the time appearing on the display unit 154. Once the desired new cooking time is indicated, the user stops pressing the left-side front portion 265L.

If the user wants to reduce the current cooking time during the operation of the microwave oven, he should press the right-side front portion 265T of the display protecting member 155 corresponding to the tack switch 240 which reduces the current cooking time in order to establish a desired new cooking time.

What is claimed is:

1. A microwave oven comprising:

a main body having a cooking chamber;

a high-frequency microwave generator disposed in the main body for supplying high-frequency microwaves to the cooking chamber;

a control panel disposed at a from surface of the main body and including switches for inputting respective cooking functions;

a display provided on the control panel for displaying data corresponding to input cooking functions;

a transparent display protecting member overlying the display and a number of the switches, the number of switches being less than all of the switches, the protecting member including switch-actuating sections facing respective ones of the number of switches; and a plurality of elastic elements spaced from the number of switches and arranged for yieldably biasing the protecting member outwardly away from the number of switches to space the switch-actuating sections from their respective switches;

the protecting member being depressible at any one of selected locations thereon corresponding to respective ones of the switch-actuating sections for causing only one of the switch-actuating sections to actuate its respective switch while causing at least one, and less than all, of the elastic members to be flexed to store energy.

2. The microwave oven according to claim 1 wherein the switches include button switches and tack switches, the at least one switch that is actuable by the display protecting member being a tack switch.

3. The microwave oven according to claim 1 wherein one of the number of switches is an on-ff switch.

4. The microwave oven according to claim 1 wherein the switch-actuating sections are defined by projections extending toward respective ones of the number of switches.

5. The microwave oven according to claim 1 wherein the number of projections equals the number of elastic members, the elastic members arranged adjacent respective ones of the projections.

6. The microwave oven according to claim 1 wherein each of the projections includes a lug arranged to engage the main body during movement of the protecting member away from the display, for limiting the extent of such movement.

7. The microwave oven according to claim 1 wherein the switch-actuating sections are spaced apart around an outer periphery of the protecting member, a center portion of the protecting member arranged for overlying the display.

8. The microwave oven according to claim 1 wherein the control panel further includes a keyboard possessing others of the switches, the protecting member being spaced from the keyboard.

* * * * *